United States Patent [19]

Hachimori

[11] Patent Number: 4,638,239

[45] Date of Patent: Jan. 20, 1987

[54] REFERENCE VOLTAGE GENERATING CIRCUIT

[75] Inventor: Takeshi Hachimori, Kanagawa, Japan

[73] Assignee: Sony Corporation, Tokyo, Japan

[21] Appl. No.: 817,555

[22] Filed: Jan. 10, 1986

[30] Foreign Application Priority Data

Jan. 24, 1985 [JP] Japan ..... 60-11542

[51] Int. Cl.[4] ..... G05F 3/20

[52] U.S. Cl. ..... 323/281; 323/280; 323/314

[58] Field of Search ..... 323/280, 281, 311–316

[56] References Cited

U.S. PATENT DOCUMENTS

| | | | |
|---|---|---|---|
| 4,064,448 | 12/1977 | Eatock | 323/281 |
| 4,095,164 | 6/1978 | Ahmed | 323/280 X |
| 4,260,946 | 4/1981 | Wheatley, Jr. | 323/281 X |
| 4,339,707 | 7/1982 | Gorecki | 323/281 X |
| 4,559,488 | 12/1985 | Minakuchi | 323/281 |

*Primary Examiner*—Peter S. Wong

*Attorney, Agent, or Firm*—Lewis H. Eslinger; Alvin Sinderbrand

[57] ABSTRACT

A reference voltage generating circuit has a control transistor whose collector-emitter path is connected between the output terminal and an input terminal, first and second resistors connected in series with the collector-emitter path of a current detection transistor between the output terminal and ground with the base of the current detection transistor being connected to a connection point between the first and second resistors, a third transistor whose base-emitter path is connected in parallel to the collector-emitter path of the current detection transistor and which has an emitter periphery area n times an emitter periphery area of the current detection transistor, a fourth transistor of the same conductivity type as the current detection transistor and the base of which is connected to the base of the current detection transistor, and a circuit in which a difference between the collector currents of the third transistor and the fourth transistor is detected and a corresponding signal is negatively fed back to the base of the control transistor for ensuring that a constant reference voltage is provided at the output terminal.

5 Claims, 4 Drawing Figures

REFERENCE VOLTAGE GENERATING CIRCUIT

BACKGROUND OF THE INVENTION

1. Field of the Invention

This invention relates to a reference voltage generating circuit and more particularly to a reference voltage generating circuit for generating a reference voltage of low level.

2. Description of the Prior Art

When the signal processing system of a radio receiver is formed as an integrated circuit (IC), a reference voltage supply source must be provided within the IC as a bias source for a transistor therein or for comparing or shifting the levels of certain signals relative to the reference voltage. When a radio receiver, which can be operated by, for example, two dry cells of size AA, is considered, the reference voltage therefor becomes about 1 to 1.5 V.

In the prior art, a reference voltage generating circuit is provided with a resistor and a single diode or two diodes connected in series between a power source terminal (input terminal) and the ground and a reference voltage is derived from the connection point between the resistor and the diode or diodes. However, such known reference voltage generating circuit is dependent on the temperature and hence has a poor temperature characteristic. Although a reference voltage generating circuit has been proposed with a good temperature characteristic, such prior art circuit is disadvantageous in that the reference voltage is considerably dependent on the input voltage or its fluctuation.

OBJECTS AND SUMMARY OF THE INVENTION

Accordingly, it is an object of this invention to provide a reference voltage generating circuit which has an excellent temperature characteristic.

It is another object of this invention to provide a reference voltage generating circuit which is substantially free of any dependency on voltage variations at the input.

It is a further object of this invention to provide a reference voltage generating circuit which can generate a reference voltage of a low level.

According to an aspect of this invention, there is provided a reference voltage generating circuit comprising: a control transistor whose collector-emitter path is connected between an output terminal and an input terminal; a current detection transistor whose collector-emitter path is connected in series to series-connected first and second transistors between the output terminal and ground, with a base of the current detection transistor being connected to a connection point between the first and second resistors; a third transistor whose base-emitter path is connected in parallel to the collector-emitter path of the current detection transistor and having an emitter periphery area n times an emitter periphery area of the current detection transistor; a fourth transistor of the same conductivity type as the current detection transistor and whose base is connected to the base of the current detection transistor; and detecting means for detecting a difference between a signal corresponding to a collector current of the third transistor and a signal corresponding to a collector current of the fourth transistor and providing to a base of the control transistor a negative feedback signal corresponding to such difference.

The above, and other objects, features and advantages of the present invention, will become apparent from the following detailed description of the preferred embodiments read in conjunction with the accompanying drawings, in which like reference numerals designate corresponding elements and parts.

DESCRIPTION OF THE PREFERRED EMBODIMENTS

Figure 1:
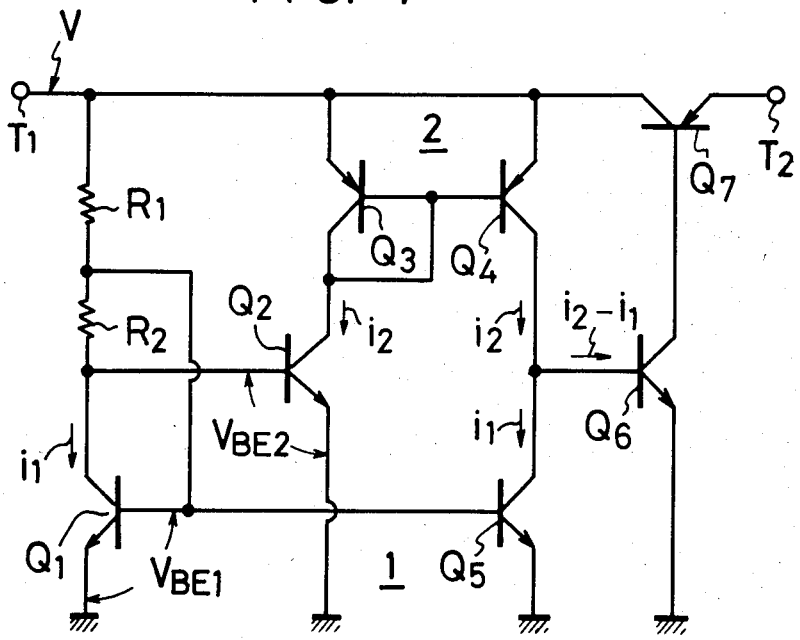
FIG. 1 a connection diagram showing a reference voltage generating circuit according to a first embodiment of the present invention.

Referring to FIG. 1 in detail, it will be seen that a reference voltage generating circuit according to this invention, as there illustrated, has an output terminal $T_1$ from which a reference voltage is derived, and an input terminal $T_2$ connected to a dry cell or the like and which is supplied with an input voltage (power supply source voltage). Between these terminals $T_1$ and $T_2$, there is connected the collector-emitter path of a control transistor $Q_7$.

Between the terminal $T_1$ and the ground, there are connected, in series, a resistor $R_1$ having a relatively large resistance value, for example, 12.6kΩ, a resistor $R_2$ having a relatively small resistance value, for example 820 and the collector-emitter path of a current detection transistor $Q_1$. The connection point between the resistors $R_1$ and $R_2$ is connected to the base of transistor $Q_1$. Further, the base-emitter path of transistor $Q_1$ is connected in parallel with the base-emitter path of a transistor $Q_5$, thereby forming a current mirror circuit 1 having the ground as its reference potential.

The collector of transistor $Q_1$ is also connected to the base of a transistor $Q_2$ and the emitter of this transistor $Q_2$ is connected to ground while the collector thereof is connected to the collector of a transistor $Q_3$.

The transistor $Q_3$ employs terminal $T_1$ as a reference potential point and, together with a transistor $Q_4$, forms a current mirror circuit 2. Therefore, the bases of transistors $Q_3$ and $Q_4$ are connected together and are further connected to the collector of transistor $Q_3$, while the emitters of transistors $Q_3$ and $Q_4$ are connected together to terminal $T_1$.

As the detecting means of an inverting amplifier, there is provided a transistor $Q_6$ with the emitter thereof being grounded, and the base thereof being connected to the collectors of transistors $Q_4$ and $Q_5$. The collector of transistor $Q_6$ is connected to the base of the control transistor $Q_7$.

The above described circuit is formed as an integrated circuit (IC) on one semiconductor chip, with the emitter periphery area (emitter-base junction area) of transistor $Q_2$ selected to be n ($n>1$) times the emitter periphery area of transistor $Q_1$.

In this circuit arrangement of FIG. 1, if $i_1$ is the collector current of transistor $Q_1$ and $i_2$ is the collector current of transistor $Q_2$, since transistors $Q_1$ and $Q_5$ constitute current mirror circuit 1, the collector current of transistor $Q_5$ also becomes $i_1$. Further, since the collector current $i_2$ of transistor $Q_2$ is equal to the collector current of transistor $Q_3$ and transistors $Q_3$ and $Q_4$ constitute current mirror circuit 2, the collector current of transistor $Q_4$ is equal to collector current $i_2$.

Accordingly, the difference $(i_2-i_1)$ between collector currents $i_2$ and $i_1$ flows to the base of transistor $Q_6$.

If the collector current $i_1$ tends to increase or the collector current $i_2$ tends to decrease, the difference current $(i_2-i_1)$ decreases, so that the collector current of transistor $Q_6$ is decreased and the impedance of transistor $Q_7$ is increased. Thus, the voltage at terminal $T_1$ is lowered and, hence, the collector current $i_1$ is decreased and the collector current $i_2$ is increased. Therefore, a negative feedback action is provided by which the collector currents $i_1$ and $i_2$ are stabilized to be constant values. In other words, if the base-emitter voltage of transistor $Q_1$ is $V_{BE1}$ and the base-emitter voltage of transistor $Q_2$ is $V_{BE2}$, the following Equations (i), (ii) and (iii) can be established:

$$V_{BE1}=R_2 \cdot i_1+V_{BE2} \quad \text{(i)}$$

$$V_{BE1}=V_T \ln (i_1/i_{S1}) \quad \text{(ii)}$$

$$V_{BE2}=V_T \ln [i_2/(n \cdot i_{S2})] \quad \text{(iii)}$$

in which $V_T=KT/q$ (T : absolute temperature), and $i_{S1}$, $i_{S2}$ are saturation currents for transistors $Q_1$ and $Q_2$. Thus, from Equations (i) to (iii), the following Equation (iv) is established:

$$V_T \cdot \ln(i_1/i_{S1}) = R_2\, i_1 + V_T \cdot \ln[i_2/(n \cdot i_{S2})] \quad \text{(iv)}$$

$$\therefore V_T \cdot \ln \cdot n \frac{i_1}{i_2} \cdot \frac{i_{S2}}{i_{S1}} = R_2 \cdot i_1$$

For example, if the transistors $Q_1$ and $Q_2$ are formed adjacent to each other on the same IC chip, $i_{S1}=i_{S2}$ is satisfied. Thus Equation (iv) can be rewritten as:

$$V_T \ln (n \cdot i_1/i_2)=R_2 \cdot i_1 \quad \text{(v)}$$

Modifying Equation (v) yields:

$$\ln (n \cdot i_1/i_2)=R_2 \cdot i_1/V_T$$

$$n \cdot i_1/i_2=\exp (R_2 \cdot i_1/V_T)$$

$$\therefore i_2=n \cdot i_1 \exp (-R_2 \cdot i_1/V_T)$$

Figure 2:
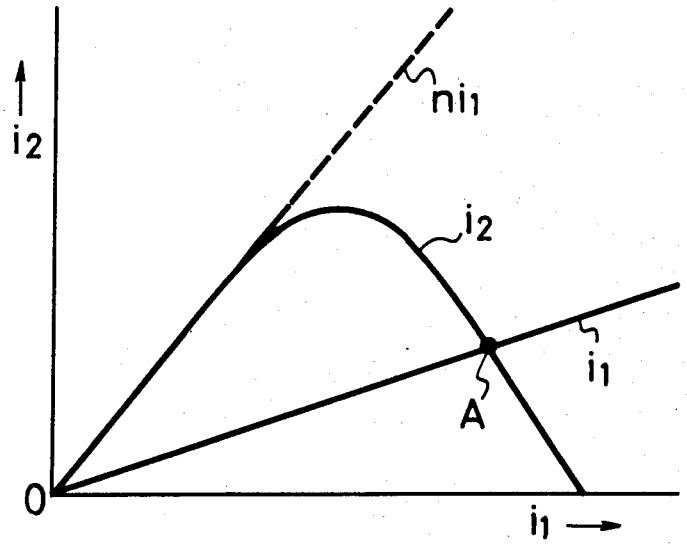
FIG. 2 is a characteristic graph of currents in the circuit of FIG. 1.

Accordingly, current $i_2$ exhibits a negative characteristic as shown in FIG. 2. Therefore, the currents $i_1$ and $i_2$ are stabilized at a point A on the negative region of the current $i_2$ where $$i_1=i_2 \quad \text{(vi)}$$

If the output voltage at terminal $T_1$ is V, the following Equation (vii) is established $$V=R_1 \cdot i_1+V_{BE1} \quad \text{(vii)}$$

Substituting Equation (vi) in Equation (v) yields:

$$V_T \ln=R_2 \cdot i_1 \quad \text{(viii)}$$

Then substituting Equation (viii) in Equation (vii) yields:

$$V=(R_1/R_2)\, V_T \ln \cdot n+V_{BE1} \quad \text{(ix)}$$

The temperature coefficient dV/dT of the voltage V is given by differentiating Equation (ix) with respect to the temperature T as in the following Equation (x)

$$\frac{dV}{dT} = \frac{K}{q} \cdot \frac{R_1}{R_2} \ln \cdot n + \frac{dV_{BE1}}{dT} \quad \text{(x)}$$

From Equation (x), the condition in which the temperature coefficient dV/dT becomes zero can be expressed by the following:

$$\frac{K}{q} \cdot \frac{R_1}{R_2} \ln \cdot n + \frac{dV_{BE1}}{dT} = 0 \quad \text{(xi)}$$

$$\therefore \frac{R_1}{R_2} \ln \cdot n = -\frac{dV_{BE1}}{dT} \cdot \frac{q}{K}$$

In other words, if Equation (xi) is established, voltage V has no temperature characteristic.

Generally, the following condition exists:

$$dV_{BE1}/dT=-1.8 \text{ to } -2.0 \text{ (mV/° C.)}$$

Thus Equation (xi) becomes the following Equation (xii)

$$\frac{R_1}{R_2} \ln \cdot n = 1.8 \times 10^{-3} \times \frac{1}{8.63 \times 10^{-5}} \cong 20.86 \quad \text{(xii)}$$

Normally in the IC, the resistance ratio $R_1/R_2$ and the area ratio n can be given the desired values relatively easily and the scatterings thereof can be suppressed sufficiently. Accordingly, since Equation (xii) can be readily achieved, Equation (xi) can also be established. Therefore, the output voltage has no temperature characteristic.

If $V_T=0.026$ (V) and $V_{BE1}=0.683$ (V), the following condition is established from Equations (ix) and (xii):

$$V=0.026 \times 20.86+0.683 \cong 1.225 \text{ (V)}.$$

Therefore, in the above described circuit according to the present invention, it is possible to obtain the reference voltage V with no temperature characteristic and which is stable when subjected to changes of temperature. In addition, this reference voltage V can be low in level, for example, 1.225V, and is suitable for an IC which can be operated at low voltage.

Since transistors $Q_1$ to $Q_5$ are supplied with the stable reference voltage V, even if the voltage at terminal $T_2$ is changed, transistors $Q_1$ to $Q_5$ can be operated stably and have small voltage dependency. Further, since the voltage at terminal $T_2$ is delivered through transistor $Q_7$ to terminal $T_1$ as the voltage V, it is possible to also obtain a current corresponding to voltage V.

Figure 3:
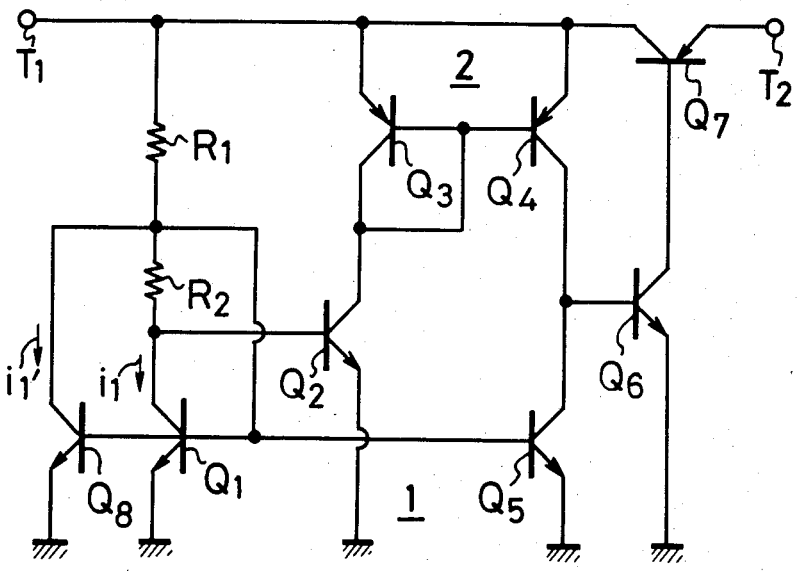
FIG. 3 is a connection diagram showing a reference voltage generating circuit according to a second embodiment of the present invention.

In the above described first embodiment, a relatively large resistance value is required for resistor $R_1$ and hence this resistor $R_1$ occupies a relatively large area in the IC semiconductor chip. Therefore, the IC semiconductor chip has to be of relatively large size. However, if the base-emitter path of one or more additional transistors having the same characteristic as the transistor $Q_1$ is connected in parallel to the base-emitter path of transistor $Q_1$, the ratio of the area occupied by resistor $R_1$ to the total area of the IC semiconductor chip can be reduced and the IC semiconductor chip can be reduced in size. By way of example, as shown in FIG. 3, in which parts corresponding to those described with reference to FIG. 1 are identified by the same reference numerals and will not be described in detail, the base-emitter path of an additional transistor $Q_8$ is connected in parallel to the base-emitter path of transistor $Q_1$. In this case, the collector of transistor $Q_8$ is connected to the connection point between resistors $R_1$ and $R_2$.

In the embodiment of FIG. 3, since the resistance value of resistor $R_2$ is very small, the collector current $i_1$, of transistor $Q_8$ is almost equal to the current $i_1$, so that a current of approximately $2i_1$ flows through resistor $R_1$. Therefore, the resistance value of resistor $R_1$ in FIG. 3 can be decreased to about one-half that of the resistor $R_1$ in FIG. 1 and the area which the resistor $R_1$ occupies on the IC semiconductor chip can be reduced. Of course, if a plurality of transistors are connected in parallel to transistor $Q_1$, the ratio of the area which the resistor $R_1$ occupies to the total are of the IC semiconductor chip can be reduced much more.

Figure 4:
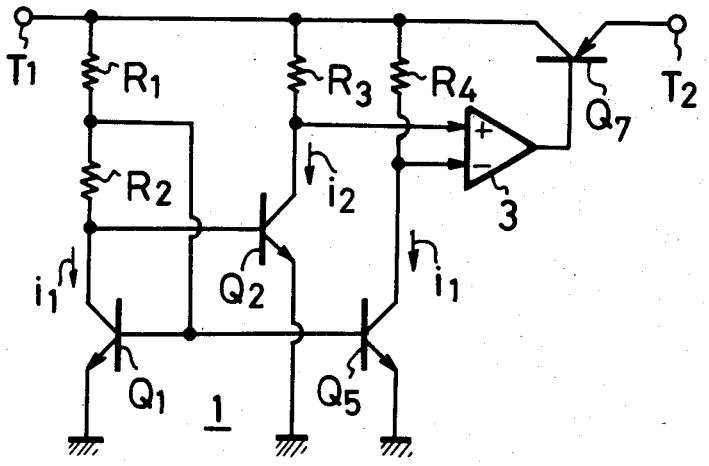
FIG. 4 is a connection diagram showing a reference voltage generating circuit according to a third embodiment of the present invention.

In the embodiment of FIG. 4, in which parts corresponding to those described with reference to FIGS. 1 and 3 are identified by the same reference numerals and will not be described in detail, the collector currents $i_2$ and $i_1$ of the transistors $Q_2$ and $Q_5$ are converted to respective voltages by resistor $R_3$ and $R_4$. The voltages corresponding to collector currents $i_2$ and $i_1$ are applied to (+) and (−) inputs, respectively, of a differential amplifier 3 and the output of the latter is applied to the base of transistor $Q_7$. Thus, control transistor $Q_7$ is operated by an output signal from differential amplifier 3 which corresponds to the difference between the voltages derived at resistors $R_3$ and $R_4$.

According to the present invention, it is possible to obtain the reference voltage V without any temperature characteristic and which is stable even when subjected to changes of temperature. Further, since this reference voltage V is low in level, such as, 1.225V, the circuit embodying the invention is suitable for an IC which is operated at low voltage.

Furthermore, since the transistors $Q_1$ to $Q_5$ are supplied with the stable reference voltage V, even if the supply voltage at the input terminal $T_2$ is changed, the stable operation can still be carried out. In addition, since the supply voltage at the input terminal $T_2$ is adjusted through the transistor $Q_7$ to the voltage V at the output terminal $T_1$, when the voltage V is obtained, it is also possible to obtain the corresponding current.

Although preferred embodiments of the invention have been described above with reference to the drawings, it will be apparent that the invention is not limited to those precise embodiments, and that many modifications and variations could be effected therein by one skilled in the art without departing from the spirit or scope of the invention as defined in the appended claims.

What is claimed is:

1. A reference voltage generating circuit comprising:

an input terminal for receiving a power supply source voltage susceptible to variation;

an output terminal from which a stable output voltage is to be derived;

a control transistor having a collector-emitter path connected between said output terminal and said input terminal;

a current detection transistor having a collector-emitter path connected in series with a series circuit of first and second resistors between said output terminal and the ground, said current detection transistor having a base connected to a connection point in said series circuit between said first and second resistors;

a third transistor having a base-emitter path connected in parallel to said collector-emitter path of said current detection transistor and having an emitter periphery area n times an emitter periphery area of the current detection transistor;

a fourth transistor of the same conductivity type as said current detection transistor and having a base connected to said base of said current detection transistor; and detecting means for detecting a difference between a signal corresponding to a collector current of said third transistor and a signal corresponding to a collector current of said fourth transistor and providing to a base of said control transistor a negative feedback signal corresponding to said difference.

2. A reference voltage generating circuit according to claim 1; in which said current detection transistor has a base-emitter path; and further comprising at least one additional transistor with the same characteristic as said current detection transistor and having a collector connected to said connection point between said first and second resistors, each said additional transistor further having a base-emitter path connected in parallel with said base-emitter path of the current detection transistor.

3. A reference voltage generating circuit according to claim 1; in which said detecting means includes a third resistor connected to a collector of said third transistor, and a fourth resistor connected to a collector of said fourth transistor; and in which said collector current of said third and fourth transistors are converted to respective voltages by said third and fourth resistor, respectively.

4. A reference voltage generating circuit according to claim 3; in which said detecting means further includes differential amplifier means having two inputs to which said voltages converted by the third and fourth resistors are respectively applied, and an output of said differential amplifier means is applied to said base of the control transistor as said negative feedback signal.

5. A reference voltage generating circuit according to claim 1; in which said detecting means includes a fifth transistor having a base and a collector-emitter path connected between said base of the control transistor and the ground, and sixth and seventh transistors constituting a current mirror circuit and having collectors connected to collectors of said third and fourth transistors, respectively, with said base of said fifth transistor being connected to a connection point between said collectors of the seventh and fourth transistors.

* * * * *